US005215396A

United States Patent [19]

Rogers

[11] Patent Number: 5,215,396

[45] Date of Patent: Jun. 1, 1993

[54] POSITION FINDING OVERLAY FOR FORMS

[76] Inventor: Ray A. Rogers, 2065 Meadowview La., Memphis, Tenn. 38116-8135

[21] Appl. No.: 710,329

[22] Filed: Jun. 5, 1991

[51] Int. Cl.[5] ..... B41J 11/64

[52] U.S. Cl. ..... 400/718; 400/704; 33/1 B

[58] Field of Search ..... 400/679, 703, 704, 705, 400/705.1, 705.4, 705.5, 706, 709, 709.1, 709.2, 718, 718.1, 718.2, 68; 33/1 B; 283/115

[56] References Cited

U.S. PATENT DOCUMENTS

| | | | |
|---|---|---|---|
| 1,429,485 | 9/1922 | Brittan | 400/706 |
| 1,587,133 | 6/1926 | Anhof | 33/1 B |
| 2,375,427 | 5/1945 | Mannino | 400/718 |
| 3,587,812 | 6/1971 | Budenstein | 400/705 |
| 4,159,130 | 6/1979 | Larrabee | 400/705.5 |
| 4,475,288 | 10/1984 | Pellegrom | 33/1 B |
| 4,599,798 | 7/1986 | Steele | 33/1 B |
| 4,860,456 | 8/1989 | Arano | 33/1 B |

FOREIGN PATENT DOCUMENTS

| | | | |
|---|---|---|---|
| 529590 | 6/1955 | Italy | 33/1 B |

*Primary Examiner*—David A. Wiecking
*Attorney, Agent, or Firm*—Richard C. Litman

[57] ABSTRACT

A transparent plastic overlay includes row and column markings. The overlay is aligned and laid onto a form. The form has areas which are to be filled in by a computer-driven printer. The overlay markings tell a user the row and column coordinates of every character position that can be printed on the form. The overlay markings are sized for the particular type font and spacing used by the printer. Knowing the column and row where a character should be entered, the user can easily move the cursor of the computer screen to the corresponding position using the cursor controls and the row and column data which are displayed on the screen by the computer's word processing program. The user then types on the computer keyboard the data or word characters to be printed on the form. The form is fed through the printer and the characters are printed in the correct positions. The overlay can be made in different sizes to fit the various typeface sizes and line spacings of different printers. The markings may be colored to contrast with the typical black ink of the forms to be printed.

12 Claims, 2 Drawing Sheets

POSITION FINDING OVERLAY FOR FORMS

FIELD OF THE INVENTION

The present invention relates to transparent overlays which are used for finding line and column positions on a form.

DESCRIPTION OF THE PRIOR ART

Today there are many forms to be filled out. The computer-driven automatic printer, with its high speed and its ability to modify and correlate information, is an obvious candidate to ease the work of filling out the multitude of forms. But as yet, the computer's promise has not been fulfilled.

The central problem in use of a computer is that characters (letters or numerals) are entered on a screen, and positions on the screen are difficult to correlate to positions on a paper form.

The computer typically accepts characters through a word processing program. The program places every character into a rectangular grid having rows and columns. The computer both displays the characters on the computer's screen in this rectangular format, and also causes the printer later to print the characters in the same format. A flashing cursor on the screen indicates to the user the current position at which a character, entered via the keyboard by depressing a keyboard key, will be placed.

The characters may appear on the computer screen either justified or unjustified. All word processing programs allow unjustified ("quad left" or "ragged right") entry of characters on a line for both screen display and printing. This mode of entry is assumed in the following discussion.

The rectangular printing grid typically used by computer printers originated with the typewriter. Before the typewriter, printing was done by hand-set type, which employed letters of various widths: an "m" would be wider than an "i", for example, and upper case letters wider than lower case. The length of an unjustified line of type would depend, not only on the number of letters in the line, but also on the particular letters that happened to be in it. With the advent of the typewriter, variable width spaces for various letters and numerals was impractical, so each letter was allocated the same width and the letters were arranged in a rectangular grid. The rectangular grid layout was not as attractive as the letters of various widths, so special typewriter fonts were developed which made narrow letters wider and wider letters narrower.

Some computers have sophisticated programs adapted to variable letter width fonts, which can adjust the spacing of letters and numerals on a line to place them "between" grid spaces. Such programs, typically driving a laser printer, will allot more width to some letters than to others. These are generally not used in modern general-purpose printers, which stick to the rectangular grid. A printer/program combination used for filling in a form is unlikely to be a laser printer driven by a sophisticated typeface program: pleasing appearance will be secondary to speed and expense.

The typical rectangular grid word processing program informs the user of the cursor location by page, line (row on a page) and column. The WORDSTAR program, for example, displays "P3 L44 C27" at the top of the screen to indicate that the cursor is currently on page 3, in the 44th row of type down from the top of the page), and in the 27th column (27 character spaces from the left-hand margin).

Unless the program is set to fully justify or to justify right, the computer's printer will print the character entered at that position in a corresponding position on a paper fed through it. The user, by watching the location, can place any character in any position on the printed page.

(The screen grid and the printing grid will have a one-to-one correspondence in coordinate positions. The physical sizes of the grids are of course unrelated. A printer may use any type from 6-point to 48-point, and the line spacing may be varied. The numbers denoting the row and column positions of any character in the grid will not vary with the font size or line spacing, though.)

Despite having the cursor grid coordinates, the user will still find it difficult to use the cursor coordinate information in filling out a form. The form will typically have boxes, underlines, or other indications of where characters must be entered, but the form will give no notice of what the coordinates of any space are. Thus the cursor position information is useless for entering characters to be printed in the boxes of the form.

The prior art shows various inventions dealing with computer printing of forms.

Tanaka, in U.S. Pat. No. 4,826,333, discloses a method of printing forms from computer memory which includes software to merge old fields of data with new fields of data, so that the old data need not be reentered for each form printed.

Suganuma et al., in U.S. Pat. No. 4,542,378, teach a software method for aligning print with the corresponding spaces on a form. The form is "read" with a scanner and the scanner data is input to the computer. The computer thus contains a digitized image of the form. Another sheet containing characters is then scanned. The two digitized images are superimposed electronically and then can be printed out.

This invention has the disadvantage that the image is stored in pixel form, which uses much computer memory. The software required consumes time, memory and money.

Lemelson discloses an apparatus, and a method somewhat similar to that of Suganuma et al., in this U.S. Pat. No. 3,872,462. Lemelson's method video scans a form, stores the image electronically or on magnetic tape, and projects the form image onto the screen of a special cathode ray tube (CRT). The CRT is of the storage type for holding the image of the form on the screen. It also includes an additional read-write electron gun and character-generating software to "fill in" the blanks of the screen-displayed form with appropriate characters. When the blanks are filled, the entire screen image, consisting of the form image and the superimposed character images which fill in the form, are printed as one. The printing may be by various means such as POLAROID TM camera or the XEROX TM process, which make a hard copy of the full screen image. Printing with an ordinary printer driven through the computer port is not taught by Lemelson.

Lemelson teaches other embodiments using microfilm projection of the form and other variations. All share the disadvantage of requiring expensive, specialized equipment such as three-gun CRTs, microfilm cameras and projectors, and specialized printing equipment that must be adapted to the rest of the expensive, specialized equipment. The invention does not use ordinary office equipment, that is, a desk-top computer and printer with an ordinary CRT and a word processing program. Furthermore, the printing of an entire screen, including not only the filled-in or entered characters, but also the form itself, is wasteful. It is much cheaper and faster, and less troublesome, to print forms on a printing press.

Hodge et al., in U.S. Pat. No. 4,559,705, disclose a thin plastic overlay to be placed onto the screen of a computer. It is attached to the screen by electrostatic force. The overlay includes indicia or markings, which enumerate the rows and columns of character positions on the screen. The overlay is used to enter, in the proper positions on the screen, those characters which will later be printed on the form by computer-controlled printing. The overlay numbers the array screen character spaces by two coordinates, row and column.

The permanent markings on the overlay only denote the character position coordinates on the screen. Additional markings made with a grease pencil or the like can be added to mark particular spaces corresponding to boxed or underlined blank spaces on the form. These spaces are filled in with characters; the characters are stored in the computer memory; and the characters are then printed on a form by an ordinary printer driven from the computer port.

The line and column indicia on the overlay of Hodge et al. appears to be redundant in most cases, because the word processing programs used to enter data and word characters almost universally include a display of the line and column position of the cursor. Hodge et al. state that their invention is intended for computers without such a display.

The Hodge et al. invention does not help to find positions on the forms. The array or grid of character areas on the computer screen is generally of different dimensions than is the corresponding array of character areas created by the printer. The two arrays will have the same number of characters per line and lines per page—the same coordinate enumerations along the respective axes—but the physical height and width of the character area, and the ratio of height to width of that area, will be different between the screen and the printed page. The screen overlay is thus useless for finding character area coordinates on the form itself.

The Hodge et al. invention is specialized to the computer screen, not to the printer. If the printer is replaced with a new one which prints in a type font of different type size (number of points), or which spaces the lines differently, the characters will not be entered correctly: the computer array is unchanged in dimensions, but the corresponding printer array is changed in size. The old form fed through the new printer will have the fill-in characters entered in the wrong places. The user will then need to recalculate all the coordinate positions for screen character entries, and draw new grease pencil markings.

On the other hand, if the printer is left as is and the computer screen is changed, the Hodge et al. overlay becomes useless.

The Hodge et al. overlay addresses only half of the problem of entering characters in a computer so that they will be printed in correct areas of a form. The task of finding the positions of spaces on the form is ignored by their device.

None of the above inventions and patents, taken either singly or in combination, is seen to describe the instant invention as claimed.

The prior art does not show any method or device for finding the character array coordinates of the parts of a form that need to be filled in, which requires only simple equipment, and which is adapted to the typical word processing program that tells the cursor position.

Accordingly, one object of the present invention is a device for finding positions on a form where characters are to be printed, which is simple, inexpensive and easy to use.

Another object is such a device which is adapted to use with ordinary computer and printing equipment.

These and other objects of the present invention will become readily apparent upon further review of the following specification and drawings.

SUMMARY OF THE INVENTION

The present invention is a transparent plastic overlay which includes row and column markings. The overlay is aligned and laid onto a form. It may include means for aligning (blank border areas) and for adhering to the form. The form has areas which are to be filled in using a computer-driven printer. The overlay markings tell a user the row and column coordinates of every character position that can be printed on the form. The overlay markings are sized for the particular type font and spacing used by the printer. Knowing the column and row where a character should be entered, the user can easily move the cursor of the computer screen to the corresponding position using the cursor controls and the row and column data which are displayed on the screen by the computer's word processing program. The user then types on the computer keyboard the data or word characters to be printed on the form. The form is fed through the printer and the characters are printed in the correct positions. The overlay can be made in different sizes to fit the various typeface sizes and line spacings of different printers. The markings may be colored to contrast with the typical black ink of printed forms.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
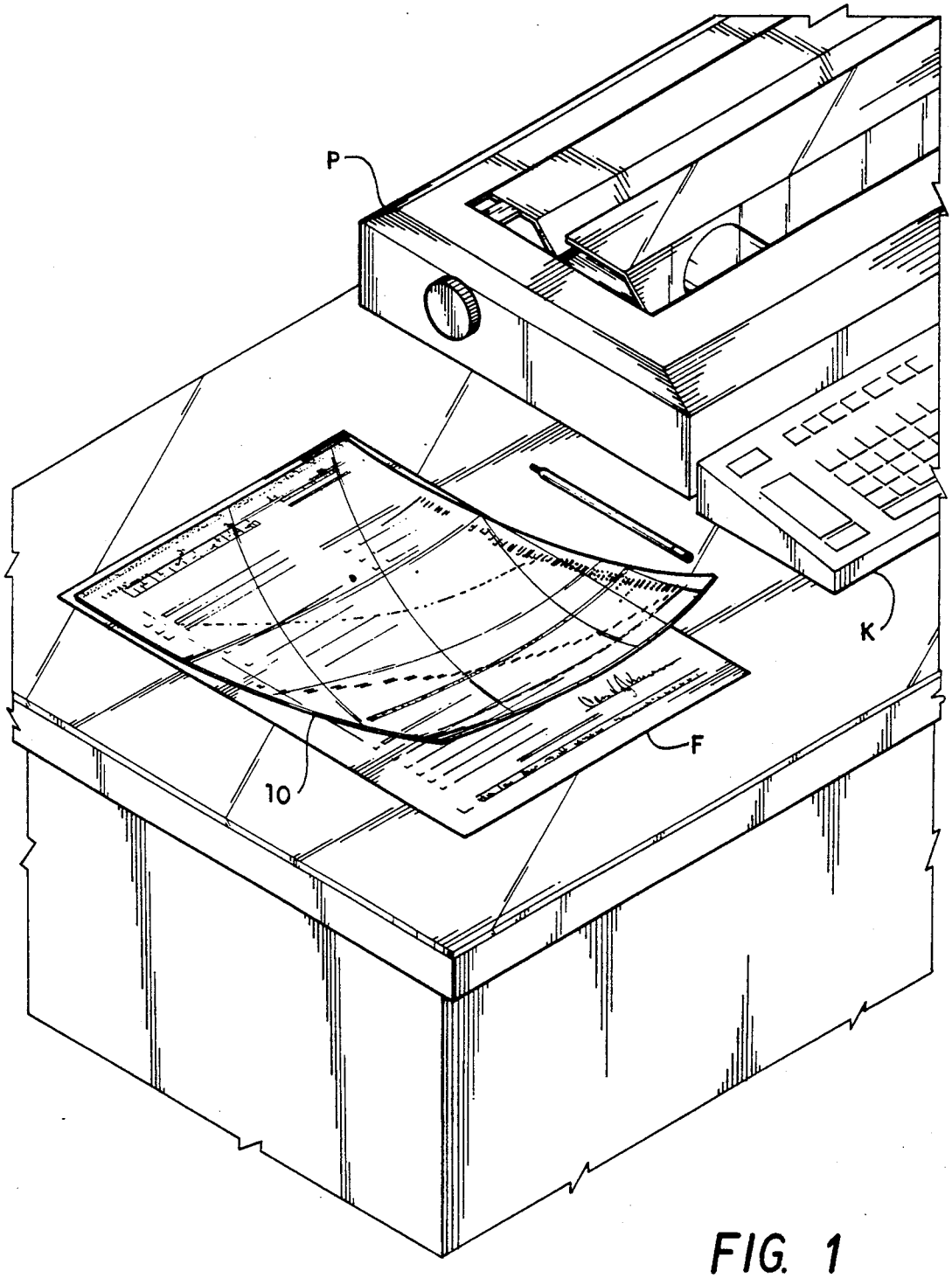
FIG. 1 is perspective view of a form with the overlay of the present invention aligned to and partially laid upon it. A portion of a computer printer is shown adjacent the form and overlay.
Figure 2:
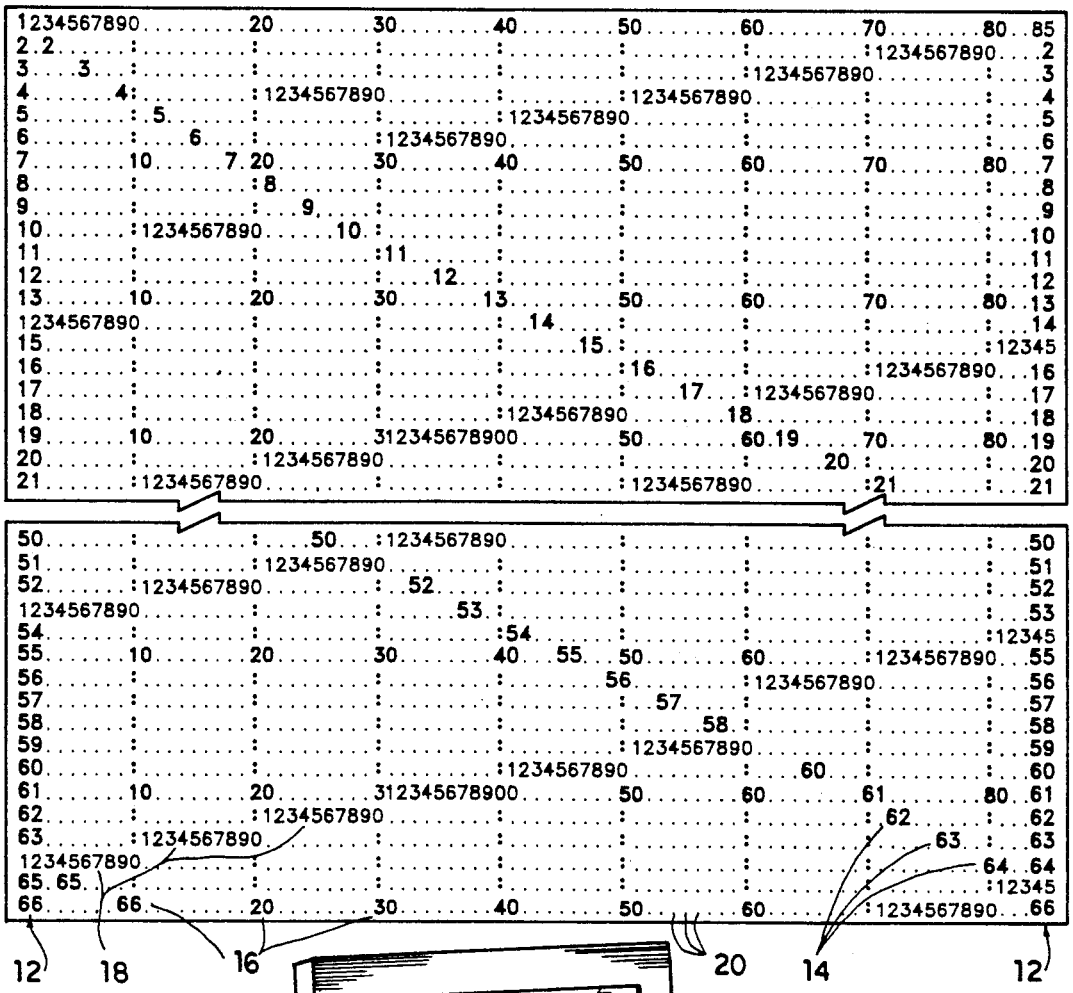
FIG. 2 is plan view of the overlay of the present invention showing the markings used for finding coordinates of positions on the form.

The present invention is an overlay 10 to aid in printing characters on a form F with a printer P; it is shown in use in FIG. 1. The markings of the invention are shown in FIG. 2. The overlay 10 is preferably made of made of clear plastic thin enough to be flexible. Physically, the overlay 10 need only be adapted to lie in close contact with a piece of paper such as a form F, so as to allow a user to see the form F through the overlay 10 when so laid onto the form F, and to extend over an area sufficient to cover areas of the form F which will be printed on. The overlay sheet must also accept markings as described below.

The overlay 10 is preferably rectangular in outline. The overlay 10 will include a rectangular grid portion, which will lie over the part of the form F on which the printer is capable of printing. The overlay 10 proper, including the grid portion and any surrounding border areas 40, need not be the same overall size as the form F itself. The overlay 10 shown in FIG. 2 has only narrow borders 40: the grid area with numerals, and the periphery of the plastic sheet of the overlay 10, are nearly coincident.

The transparent overlay 10 is laid onto the form F and aligned with it. The border areas 40 are preferably of such a width that when the edges of the form F are aligned to the edges of the overlay 10, the grid portion of the overlay 10 will coincide with the area of the form F accepting characters. That is, the printer P will have set gaps between the edge of a paper fed into it and the edge of the printed area; these are made equal to the borders 40. Other alignment means, such as markings in the border areas, are also possible.

Figure 3:
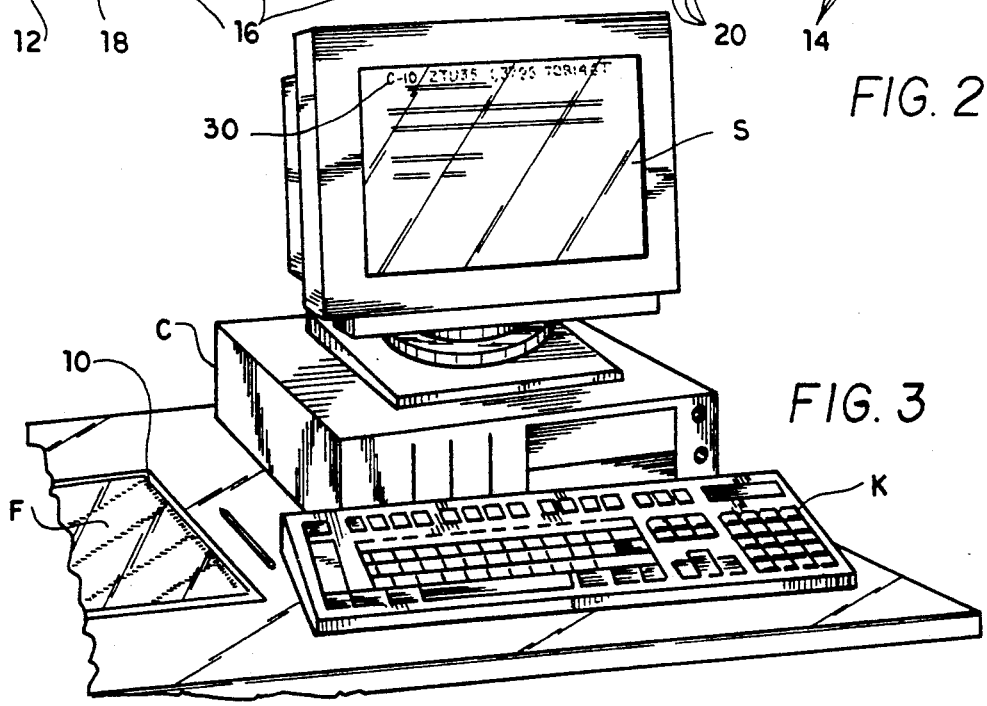
FIG. 3 is a perspective view of the invention with a typical computer and screen. Characters and cursor information are displayed upon the screen.

In addition, the border areas 40 may include material which is different from the material of the overlay, such as a thickened area or a cardboard frame glued to the outside of the overlay 10. Such an area is shown in FIG. 3.

The overlay 10 may include means for adhering it to a form to keep them in alignment. Such means might be reusable adhesive, electrostatic means, tape, etc.

The markings, best shown in FIG. 2, are for determining a row coordinate and a column coordinate of each character position on the form F. The printer P can print characters into any element of a rectangular array of identical rectangular areas on the form F. Each of these areas can accept exactly one printed character. The markings are to denote these areas on the form F.

The grid portion has a height and a width. The height divided by the row total (number of rows) equals the line spacing or "leading" line separation of the printer P. (The term "leading" comes from strips of lead which are inserted between lines of type in hand type lay-up.) The width divided by the column total equals the character width of the printer P, that is, the width allotted to one character.

The markings on the overlay 10 are integer numerals which denote the coordinates. The coordinates are enumerated in the usual way, left to right for column numbers and top to bottom for row numbers. The row enumeration progresses by integers from one at the top edge to the total number of rows at the bottom edge; the column enumeration goes from one at the left edge to the column total on the right edge. The enumeration is denoted by numeral markings on the overlay 10.

To place on each character area one numeral describing the row number, and another describing the column number, would make the overlay 10 too crowded with numerals. Therefore only some of the enumerated areas are denoted by numerals. The enumeration of the others may be found by interpolating between nearby numerals. The areas not denoted may be left blank, or denoted by a dot or a period 20.

The preferred embodiment is shown in FIG. 2. Several superimposed patterns of numerals denoting both row and column enumeration are shown. The present invention is not limited to the particular combination of marking patterns shown, but includes any sub-combination thereof, and any other markings within the scope of the claims.

One pattern comprises two columns 12 of row-enumerating numerals down the left and right edges of the grid area. When the grid portion of the overlay 10 is aligned onto the rectangular array of character printing areas on the form F, these will denote the row number. The enumeration goes from one to the row total: the numerals start with "1" and progress to "66" on the particular overlay 10 shown in FIG. 2.

A second pattern is a series of diagonals 14 consisting of row-enumerating numerals. These make it easy to find the row number for a character area in the middle of the grid portion. There may be one or more diagonal lines of numerals depending on the length of the grid portion and design choices.

The column numbers are denoted by several patterns disposed in rows across the grid portion. At the top edge and the bottom edge, and at various places in between, there is a row of column-denoting numerals 16 which progress by tens, that is, "10", "20", "30", and so on. The numerals are separated by dots or periods. The user can easily find a particular column enumeration by counting a few periods from the numeral.

To avoid crowding of the numerals, the two digits of each numeral are placed on separate but adjacent character areas. That is, for example the marking "50", which denotes the 50th column area, has "5-" in the 50th row position and "-0" in the 51st position. The remaining positions are occupied by periods.

Within the vertical columns of similar rows of column-denoting numerals the periods are replaced by colons. This helps the user's eye to find the proper column enumeration of a character area.

To further aid the user in this task, the markings may include a staggered plurality of a horizontal sequence 18 of the numbers 1, 2, 3, 4, 5, 6, 7, 8, 9, 0. Each sequence is horizontally adjacent another identical sequence to form a reiterating progression modulo 18. Each one of the plurality occupies one row; the next one of the plurality occupies another row vertically adjacent. The result is a "staircase" each of whose steps is the numeral markings "1 2 3 4 5 6 7 8 9 0". The steps should jump up or down when they would interfere with a diagonal if in the sequential position.

The markings may be black, but preferably are colored to contrast with the ordinary black ink of a form. The row and column markings may be colored differently for easier use, as may the various patterns.

To use the present invention, the array of the overlay 10 must be sized to fit the type size and leading of the printer P. If various printers are used, an overlay may be provided for each one.

Having aligned the overlay 10 to the form F, and having determined the proper coordinates of a blank fill-in space on the form F by the use of the numerals and dots, the user moves the cursor to the corresponding position. The cursor will appear on the screen S of the computer C, shown in FIG. 3. The screen S includes indications 30 of cursor position by line (row) and column. Such indications are generated by the word processing program of the computer C. With the cursor positioned at the corresponding place, as evidenced by cursor position numbers on the screen S matching the numbers on the overlay 10, the user enters the information (characters) needed to fill in that part of the form F. The characters are stored electronically in a computer C. The computer is then programmed to drive the printer P to print on the form F or on an identical form. The printed characters will appear in their proper places.

It is to be understood that the present invention is not limited to the sole embodiment described above, but encompasses any and all embodiments within the scope of the following claims.

I claim:

1. A transparent overlay providing for the accurate printing of characters onto a form, the characters printed by means of a printer driven by a computer and the computer having character input means and a screen with and a movable cursor, said transparent overlay comprising:

a single sheet of material having thereon a plurality of rows and a plurality of columns to be overlaid onto a form and aligned thereupon for determining a row coordinate and a column coordinate of one area of a rectangular array of rectangular areas on a form, each of the areas for accepting one of the characters;

integer numeral markings on said overlay denoting an ordered integer coordinate row enumeration of the array and an ordered integer coordinate column enumeration of the array and including a plurality of dots each denoting an area;

said integer numeral markings including a staggered plurality of a horizontal sequence of numerals 1, 2, 3, 4, 5, 6, 7, 8, 9, and 0, each one said sequence horizontally adjacent another said sequence to form a reiterating progression of said sequence, each one of said plurality occupying one of said rows, said other one of said plurality occupying another of said rows vertically adjacent said first one of said rows;

said overlay including a rectangular grid portion having a top edge, a bottom edge, a left edge, and a right edge, said row enumeration progressing integrally from one at said top edge to a total number of said rows at said bottom edge, said column enumeration progressing integrally from one at said left edge to a total number of said columns at said right edge;

said grid portion having a height, said height divided by said total number of said rows equal to a line spacing of a printer;

said grid portion having a width, said width divided by said total number of said columns equal to a character width of a printer;

a sequence of said plurality of dots being placed horizontally along each of said rows not containing said column enumeration according to said horizontal sequence of numerals;

another sequence of said plurality of dots being placed vertically in areas corresponding to every tenth column starting with a tenth of said columns;

whereby said transparent overlay is placed over a form, row and column coordinates of a rectangular area of a rectangular array are determined, a screen cursor is moved to a corresponding screen position, character input means are used to enter characters into a computer, a form is inserted into a printer, and characters are printed in appropriate locations upon a form.

2. The overlay according to claim 1, including a border area for separating said grid portion from a periphery of said overlay, whereby said border area may align said overlay to the form when said periphery is made coincident with a boundary of the form.

3. The overlay according to claim 2 wherein said border area includes cardboard.

4. The overlay according to claim 1 wherein said integer numeral markings include numerals within said grid portion adjacent said left edge, said numerals denoting said row enumeration.

5. The overlay according to claim 1 wherein said integer numeral markings include numerals within said grid portion adjacent said right edge, said numerals denoting said row enumeration.

6. The overlay according to claim 1 wherein said integer numeral markings include first numerals within said grid portion adjacent said left edge to denote said row enumeration and second numerals within said grid portion adjacent said top edge to denote said column enumeration.

7. The overlay according to claim 1 wherein said integer numeral markings include first numerals within said grid portion adjacent said left edge to denote said row enumeration and second numerals within said grid portion adjacent said bottom edge to denote said column enumeration.

8. The overlay according to claim 1 wherein said integer numeral markings include first numerals within said grid portion adjacent said right edge to denote said row enumeration and second numerals within said grid portion adjacent said top edge to denote said column enumeration.

9. The overlay according to claim 1 wherein said integer numeral markings include first numerals within said grid portion adjacent said right edge to denote said row enumeration and second numerals within said grid portion adjacent said bottom edge to denote said column enumeration.

10. The overlay according to claim 1 wherein said integer numeral markings include diagonal lines of numerals denoting said row enumeration.

11. The overlay according to claim 1 wherein said integer numeral markings include vertical lines of two-digit numerals denoting said column enumeration, each said two-digit numeral including a first digit and a second digit, said second digit being 0, said numerals spaced at ten-column intervals.

12. The overlay according to claim 1, including means for adhering said overlay to a form.

* * * * *